United States Patent [19]

Wong

[11] 4,414,502

[45] Nov. 8, 1983

[54] CURRENT SOURCE CIRCUIT

[75] Inventor: Thomas S. W. Wong, San Jose, Calif.

[73] Assignee: Advanced Micro Devices, Inc., Sunnyvale, Calif.

[21] Appl. No.: 285,180

[22] Filed: Jul. 20, 1981

[51] Int. Cl.[3] ..... G05F 3/20

[52] U.S. Cl. ..... 323/315; 330/296

[58] Field of Search ..... 307/254, 296 R, 297; 323/226, 273, 280, 281, 311–317; 330/296, 297

[56] References Cited

U.S. PATENT DOCUMENTS

| | | | |
|---|---|---|---|
| 3,246,233 | 4/1966 | Herz | 323/303 |
| 3,781,648 | 12/1973 | Owens | 323/313 |
| 3,942,046 | 3/1976 | Limberg | 323/313 X |
| 4,079,308 | 3/1978 | Brown | 307/297 X |

FOREIGN PATENT DOCUMENTS

| | | | |
|---|---|---|---|
| 2533199 | 1/1977 | Fed. Rep. of Germany | 323/314 |

*Primary Examiner*—A. D. Pellinen

*Attorney, Agent, or Firm*—Patrick T. King; Gary T. Aka

[57] ABSTRACT

A current source for voltage regulators used in integrated emitter coupled logic (ECL) circuits to avoid variations in output current due to fluctuations in the voltage source. Transistors of one polarity type are employed. A current source (11) is connected to an output node (15). A transistor (Q2) generates a current proportional to the output voltage (15) to develop a voltage across a resistor (12) in turn controlling a transistor (Q3) in series with a resistor (14) and a diode connected transistor (Q4). By current mirror action the current flowing in transistor (Q4) is mirrored ($I_{Q1}$) by transistor (Q1). The output current ($I_0$) is the current flowing through resistor (11) less the current ($I_{Q1}$).

9 Claims, 5 Drawing Figures

CURRENT SOURCE CIRCUIT

BACKGROUND OF THE INVENTION

1. Field of the Invention

This invention relates to electrical circuitry providing a source of electric current and, more particularly, a current source circuit for voltage regulators used in integrated emitter coupled logic (ECL) circuits.

2. Prior Art

Some electronic circuits require a source of electric current for proper operation. In some integrated circuit technologies the current source is composed of a simple resistor having a voltage source at one end and an output terminal at the other end. To avoid the problems of variations in the output current due to fluctuations in the voltage source and the like, more elaborate circuits have been designed with active elements, such as transistors. When transistors are used, designs having transistors of mixed polarities i.e., both NPN and PNP transistors, are often employed. This is undesirable from the standpoint of integrated circuit processing since extra processing steps are often required to manufacture both polarity transistors in a single substrate. Moreover, these designs are sometimes impossible with particular process constraints.

Another problem occurs when such simple current sources are used to power voltage regulators which in turn supply voltages to the current generators of ECL circuits. With the characteristic variations in integrated circuit processing, it is difficult to determine precisely the output voltages of the ECL circuits. Variations in the voltage source also undesirably affect the responses of the ECL circuits.

SUMMARY OF THE INVENTION

The present invention is directed toward solving or substantially mitigating all of these problems.

It is an object of the invention to provide for an accurate current source.

It is another object of the invention to provide for a current source compatible with integrated circuit technology, so that only transistors of one polarity type are employed.

It is still another object of the invention to provide for a current source used with a voltage regulator for ECL circuits, which allows the precise determination of output voltages of these logic circuits.

It is a further object of the invention to provide for a current source used with a voltage regulator for ECL circuits, which allows minimal ECL output changes despite variations in source voltge or process parameters.

The present invention provides for a current source circuit comprising a first resistance means connected between a first voltage supply terminal and an output node, means for generating a first current proportional to the voltage at the output node, a second resistance means connected between the first current generating means and the first voltage supply terminal, the first current through the second resistance means defining a voltage across the second resistance means, means for generating a second current proportional to the voltage across the second resistance means, means connected between the output node and a second voltage terminal for generating a third current equal to the second current, whereby the third current provides for a feedback control of an output current from the output node.

The second current generating means further comprises a third resistance means, a first transistor forming an emitter-collector current path between the first voltage supply terminal and the third resistance means, a base electrode of the first transistor connected to the node between the second resistance element and the first current generating means and a forward-biased diode voltage displacement means connected between the third resistance element and the second voltage supply terminal.

BRIEF DESCRIPTION OF THE DRAWINGS

An understanding of the invention disclosed herein may be facilitated by reference to the following drawings.

DETAILED DESCRIPTION OF THE INVENTION

In the following explanation of the present invention, a common assumption in circuit analysis is made that the base current of a transistor is so small in comparison to the emitter and collector currents of the transistor that the base current is considered negligible and that all the currents flow through the emitter and collector of a transistor. This is consistent with the assumption that the $\beta$, the current gain, of the transistor is large and that $\alpha$, the common base current gain or the ratio of the collector current to the emitter current of the transistor is nearly unity. Where the base current of a transistor is significant, it is specifically noted and accounted for.

Figure 1:
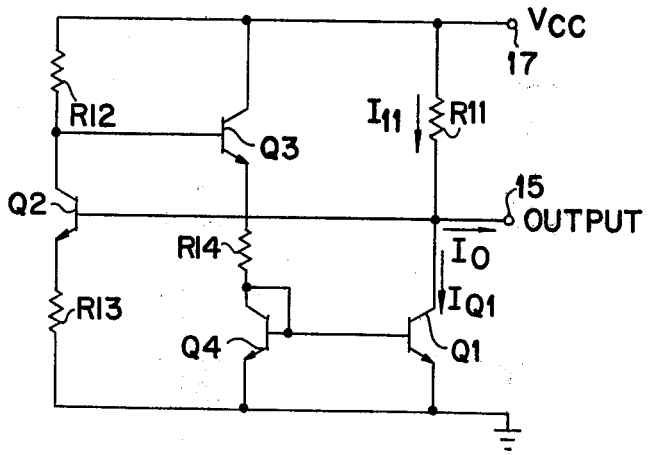
FIG. 1 is a circuit schematic of one embodiment of the present invention.

FIG. 1 is a schematic of the basic current source circuit according to the present invention. A voltage supply terminal 17 is connected to a positive voltage source at voltage $V_{CC}$. A resistance element 11 is connected between the terminal 17 and an output terminal 15 by a circuit node 10. The circuit 10 node is connected to a base electrode of a transistor Q2 which has its emitter electrode connected to ground through a resistance element 13. Thus, the output voltage of the terminal 15 $V_O$, generates a current through the resistance element 13. The current flowing through the resistance element 13, $I_{13}$, also must flow through a resistance element 12 which is connected between the collector electrode of the transistor Q2 and the voltage supply terminal 17. The voltage generated across the resistance element 12 is thus determined by the output voltage $V_O$. A transistor Q3 is made responsive to the voltage across the resistance element 12 by having its base electrode connected between the element 12 and the collector electrode of the transistor Q2. The base electrode of the transistor Q3 receives a voltage of $$V_{CC} - I_{13}R_{12} = V_{CC} - \left(\frac{V_O - V_{BE}}{R_{13}}\right) R_{12}$$

where $V_{BE}$ is the base-emitter voltage drop of a transistor in the active mode, or equivalently, the voltage drop of a forward-biased diode, and R12, R13 are the resistances of the elements 12,13 respectively.

A collector electrode of the transistor Q3 is connected to the voltage supply terminal 17, while an emitter electrode of the same transistor is connected to ground through a resistance element 14 and transistor Q4. The transistor Q4 in a diode connected mode has its base and collector electrodes connected together and its emitter electrode connected to ground. The base and collector electrodes are also connected to the resistance element 14. Thus, the current through the element 14 is determined by the voltage on the base electrode of the transistor Q3.

$$I_{14} = \frac{V_{CC} - \left(\frac{V_O - V_{BE}}{R_{13}}\right) R_{12} - 2V_{BE}}{R_{14}}$$

where $I_{14}$ is the current through the element 14 and $2V_{BE}$ is accounted for by the base-emitter voltage drops of the transistors Q3 and Q4.

The base and collector electrodes of the transistor Q4 are connected to the base electrode of a transistor Q1 which forms a current mirror of the transistor Q4. A current of equal magnitude $I_{Q1}$ must flow through the transistor Q1 as flows through transistor Q4, $I_{Q4}$.

The output current for the circuit from the node 10 is thus the current $I_{11}$ passing through the resistance element 11, as indicated by an arrow in close proximity thereto less the current $I_{14}$ passing through transistor Q1. This difference is the output current $I_O$. Since the current passing through the collector-emitter current path of the transistor Q1 is determined ultimately by the output voltages $V_O$, the output current $I_O$ has a feedback control.

$$I_O = I_{11} - I_{14}$$

$$I_O = \frac{V_{CC} - V_O}{R_{11}} - \frac{V_{CC} - \left(\frac{V_O - V_{BE}}{R_{13}}\right) R_{12} - 2V_{BE}}{R_{14}}$$

$$I_O = V_{CC}\left(\frac{1}{R_{11}} - \frac{1}{R_{14}}\right) + V_O\left(\frac{R_{12}}{R_{13}R_{14}} - \frac{1}{R_{11}}\right) + V_{BE}\frac{\left(2 - \frac{R_{12}}{R_{13}}\right)}{R_{14}}$$

To make the output current independent of the supply voltage, $V_{CC}$, and the output voltage $V_O$, the values of the resistance elements 11 and 14, $R_{11}$ and $R_{14}$, are made equal to each other and the values of the resistance elements 12 and 13, $R_{12}$ and $R_{13}$, are made equal to each other. The output current thus becomes $$I_O = \frac{V_{BE}}{R_{14}}$$

This circuit is compatible to manufacturing integrated circuit technology. While the output current $I_O$ is inversely proportional to some resistance, the current is used to generate voltages in other circuits, which, along with the current supply, could be part of a larger integrated circuit. By having $I_O$ flow through a resistance element of resistance, say, $R_O$, the generated voltage is of the form of a product $I_O R_O$ with resistance ratios determining the magnitude of the voltage. The ability for precise resistance matching and resistance ratios is one of the many advantages of integrated circuit technology.

It should be noted that all of the transistors in the circuit are of one polarity type. In this case the transistors are NPN polarity type, and no extra processing steps are required to manufacture a PNP type transistor.

Figure 2:
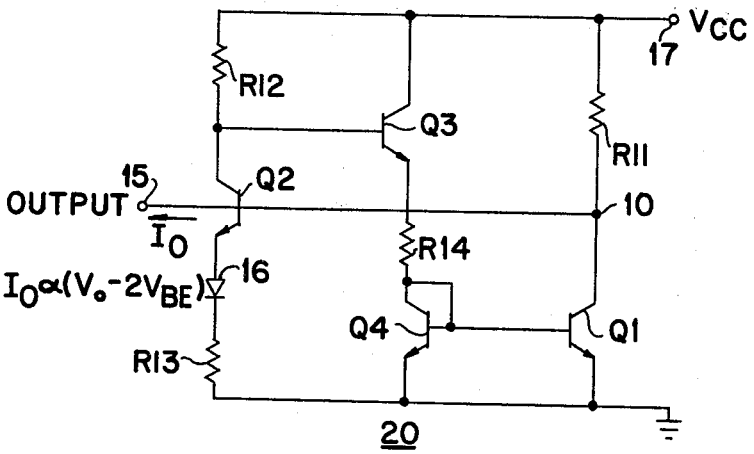
FIG. 2 is a circuit schematic of another embodiment of the present invention.

The circuit shown in FIG. 1 may be varied to modify the characteristics of the output current $I_O$. Selection of particular resistance ratios and resistance matching, such as that done above to achieve a $V_{CC}$ and $V_O$ independent current supply, is one way of modifying $I_O$ characteristics. Another way is to add circuit elements to the basic circuit. FIG. 2 illustrates this approach of circuit modification.

In FIG. 2 a diode 16 is added between the emitter electrode of the transistor Q2 and the element 13. The same reference numerals are used for the same elements as that of the previous figure. By a recalculation of the output current $I_O$ for this circuit as that done above for the circuit of FIG. 1 and by setting the resistances of the elements 11 and 14 equal, the following output current is achieved.

$$I_O = (V_O - 2V_{BE})\frac{1}{R_{11}}\left(\frac{R_{12}}{R_{13}} - 1\right)$$

What is significant is that the output current $I_O$ is proportional to the voltage ($V_O$-2 $V_{BE}$). As explained later, this allows a voltage regulator which is supplied by the current source of FIG. 2 to have certain desired properties when the voltage regulator is connected to an ECL circuit.

Figure 3:
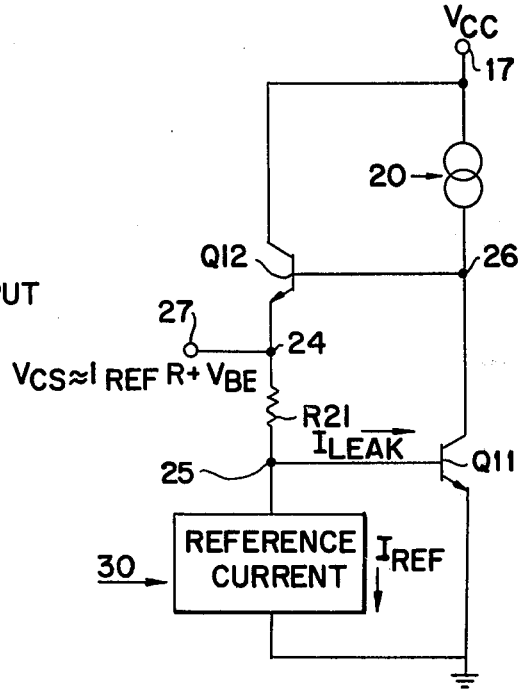
FIG. 3 is a generalized version of voltage regulators used in the prior art as voltage supply sources to ECL circuits.

Such a generalized voltage regulator circuit used in supplying voltage to logic circuits, particularly ECL circuits, is shown in FIG. 3. The output voltage of the regulator $V_{CS}$ is equal to a forward biased diode voltage drop, the base-emitter junction voltage of the transistor Q11, and the voltage generated across the resistance element 21. This voltage is set by a predetermined reference current $I_{REF}$ generated by a subcircuit, here indicated by a block 30. The current for the transistor Q11 is supplied by the current source 20 connected between the positive supply voltage $V_{CC}$ at the terminal 17 and the voltage regulator circuit at a node 26. A transistor Q12 has its emitter electrode connected to the output terminal of the circuit and its base electrode connected to the node 26. The collector electrode of the transistor Q12 is connected to the voltage supply source.

As explained above, a simple resistor is often used for the current source 20. Where better operational characteristics are required, such as independence from fluctuations in the voltage supply $V_{CC}$, transistors are also employed. However, these transistors are of both polarity types, requiring additional processing steps if the circuits are manufactured in integrated circuit form.

When the present invention is used to the current source 20, not only is the voltage regulator independent of variations in the voltage supply $V_{CC}$, but also the output voltages of the ECL circuit become amenable to precise determination.

Ideally, the voltage regulator provides an output voltage $V_{CS}$ to the ECL circuits. However, for an exact calculation of the output voltage, the base current of the transistor Q11 must be accounted for. In FIG. 3 the base current appears as an additional current $I_{LEAK}$ from the node 25 into the base electrode of the transistor Q11. The output voltage for the regulator circuit without considering the additional current $I_{LEAK}$ is $$V_{CS}=I_{REF}R_{21}+V_{BE}$$

where $I_{REF}R_{21}$ is the voltage across the resistance element 21 and $V_{BE}$ is the base-emitter voltage of the transistor Q11. The regulator output voltage must be modified to $$V_{CS}=I_{REF}R_{21}+mI_{LEAK}R_{21}+V_{BE} \quad (1)$$

where m is a feedback factor which enhances the influence of $I_{LEAK}$ when it is accounted for. $I_{LEAK}$ increases the voltage across the element 21, which raises the voltage at the node 24. This in turn increases the current $I_{REF}$, which increases $I_{LEAK}$. The voltage across the element 21 is further increased and so on. By calculation, it is found that m varies from 1.0 to 1.3 for integrated circuit NPN transistors, depending upon the various parameters of the transistors and the particular configuration of subcircuit block 30.

If a current source, such as that shown in FIG. 2, is used for the current source 20, the output voltage of an ECL circuit which is connected to the voltage regulator can be precisely determined. The output voltage $V_O$ of current source tracks the output voltage, $V_{CS}$, of the voltage regulator, and the output current, $I_O$, of the current source tracks the current through the ECL circuit. The regulator output voltage is one diode drop below the output voltage of the output voltage of the current source.

$$V_{CS}=V_O-V_{BE}$$

and the current supplied to voltage regulator is $$I_O=(V_{CS}-V_{BE})\frac{1}{R} \text{ where } \frac{1}{R}=\frac{1}{R_{11}}\left(\frac{R_{12}}{R_{13}}-1\right)$$

Since $I_{LEAK}$ is the base current of the transistor Q11, $I_{LEAK}$ is related to the collector current $I_O$, of that transistor by $\beta$ $$\beta I_{LEAK}=I_O=(V_{CS}-V_{BE})\frac{1}{R}$$

Inserting this relationship into the regulator output voltage equation, (1) given above $$V_{CS}=I_{REF}R_{21}+\frac{m}{\beta}(V_{CS}-V_{BE})\frac{R_{21}}{R}+V_{BE}$$

By algebraic manipulation $$\left(1-m\frac{R_{21}}{R}\ \frac{1}{\beta}\right)(V_{CS}-V_{BE})=I_{REF}R_{21}$$

However, $$\left(1-m\frac{R_{21}}{R}\ \frac{1}{\beta}\right)$$

is approximately $$\alpha^{\frac{mR_{21}}{R}}.$$

This can be shown by using an approximation of the binomial theorem, $$\left(1-\frac{1}{x}\right)^n\approx 1-\frac{n}{x}$$

where x is number much greater than one, as is the case for $\beta$ and by noting the identity $$\alpha=\frac{\beta}{\beta+1}$$

and by manipulation and using an approximation of the binomial theorem again, $$\left(1-\frac{1}{\beta}\right)\approx\alpha$$

for bipolar transistors. Thus $$\alpha^{\frac{mR_{21}}{R}}(V_{CS}-V_{BE})=I_{REF}R_{21} \quad (2)$$

or $$(V_{CS}-V_{BE})=\frac{I_{REF}R_{21}}{\alpha^{\frac{mR_{21}}{R}}}$$

Figure 5:
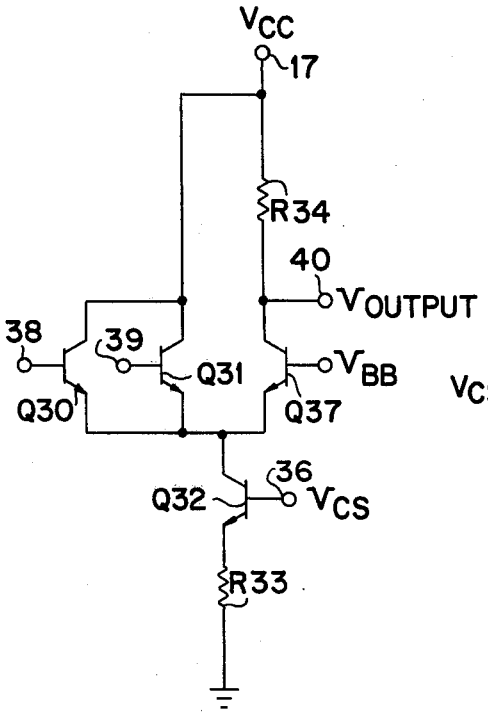
FIG. 5 is an exemplary ECL circuit.

The voltage regulator is connected to an ECL circuit of which an example is illustrated in FIG. 5. This circuit is a two-input OR gate. Two switching transistors Q30 and Q31 have their emitters coupled to the emitter of an opposing switching transistor Q37, which has its base held at a reference voltage $V_{BB}$. This voltage is fixed near the middle of the logic voltage swings of the input signals, which are received through the input terminals 38 and 39. Unless at least one of the input signals is "high" or above $V_{REF}$ so as to switch on one of the transistors Q30, Q31, the transistor Q37 is turned on.

The current path of the current generated by the transistor Q32 and the resistor element 33 is determined by the state of the transistors Q30, Q31 and Q37. When one or both the transistors Q30, Q31 are switched on, little current flows through the transistor Q37 and resistive load element 34. The output signal $V_{output}$ rises to approximately $V_{CC}$, a "high" output signal. When both input signals are "low," the current flows through the transistor Q37 and element 34, and $V_{output}$ falls, to a "low" logic level. This output voltage is $V_{CC}$ minus the voltage generated across the element 34 by the collector current of the transistor Q37.

The voltage regulator above supplies the necessary voltage $V_{CS}$ to power the current generator formed by the transistor Q32 and resistive element 33 by having the regulator output terminal 27 in FIG. 3 connected to the base terminal of the transistor Q32. The current through the emitter of the transistor Q32 is $(V_{CS}-V_{BE})/R_{33}$ where $R_{33}$ is the resistance of the element 33. Note that $(V_{CS}-V_{BE})$ is the same for $I_O$, the current supplied to the voltage regulator from the current source. The two currents track each other.

The magnitude of this emitter current is reduced by $\alpha$ through the collector of the transistor Q32, and the current through the collector of any of the switching transistors Q30, Q31 and Q37 is further reduced by $\alpha$.

The voltage swing in the output voltage of the ECL circuit is the voltage across the element 34 or the emitter current of the transistor Q32 reduced by $\alpha^2$ times the resistance of the element 34, $$\frac{(V_{CS}-V_{BE})}{R_{33}}\alpha^2 R_{34}$$

Substituting the equation (2) derived above for $(V_{CS}-V_{BE})$ into the expression directly above, the expression becomes $$\frac{I_{REF}R_{21}}{\alpha^{\frac{mR_{21}}{R}}}\alpha^2\frac{R_{34}}{R_{33}} \tag{3}$$

By setting $$\frac{mR_{21}}{R}=\frac{mR_{21}\left(\frac{R_{12}}{R_{13}}-1\right)}{R_{11}}$$

to an integer, here equal to 2, dependence upon $\alpha$ is eliminated. This is a desirable result. Integrated circuit manufacturing allows close matching of $\alpha$'s within a multitransistor integrated semiconductor device, but precise setting of $\alpha$'s is difficult, which would be required without the present invention.

By the present invention, which supplies a current to a voltage regulator for the current generator of an ECL circuit, a precise determination of the output voltage swing, and the ECL output voltages, is achieved by matching resistance values. Of note is the fact the OR gate of FIG. 5 is merely an example of an ECL circuit and the present invention benefits all ECL circuits. If the ECL circuit has two tiers of switching transistors, or, equivalently, two input signal levels, such as found in a NAND or AND circuit, the logic output voltage has an $\alpha^3$ dependence. By setting $$\frac{mR_{21}}{R}=3,$$

$\alpha$ dependence is eliminated.

Figure 4:
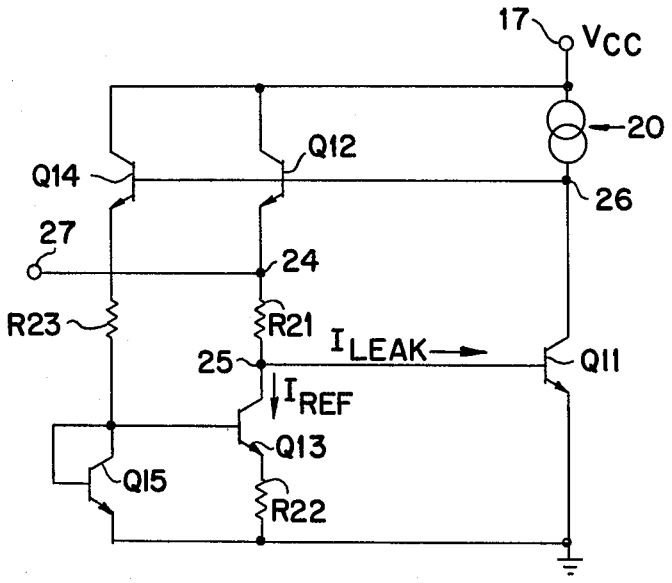
FIG. 4 is a specific circuit schematic for a voltage regulator used in the prior art for ECL circuits.

The applicability of the present invention is shown with respect to a particular voltage regulator (in FIG. 4) of the type diagrammed in FIG. 3 and commonly used for ECL circuits. Where the same elements appear in FIG. 4 as in the generalized circuit in FIG. 3, the same reference numerals are retained. The reference current $I_{REF}$ in the circuit is set by the difference in the base-emitter junction voltages of the transistor Q13 and Q15.

The voltage across the resistance element 22 is $$V_{22}=V_{BE15}-V_{BE13}$$

where $V_{BE15}$ and $V_{BE13}$ are the base-emitter junction voltages of the transistors Q13 and Q15 and $V_{22}$ is the voltage across the element 22. As is well known, the base-emitter junction voltage of a transistor can be written as a function of temperature and the density of current passing through the junction. The above equation thus becomes $$V_{22}=V_T ln(J_{15}/J_S)-V_T ln(J_{13}/J_S)=V_T ln(J_{15}/J_{13})$$

where $J_S$ is the saturation current density for integrated circuit NPN transistors. with the reasonable assumption that the voltages contributed by the resistive terms in each of the $V_{BE}$ voltages are negligible at operating current densities, where $V_T$ is $$\frac{kT}{q}.$$

k being Boltzmann's constant, T the absolute temperature in degrees Kelvin and q the magnitude of the charge of the electron, and $J_{15}$ is the current density of the transistor Q15 and $J_{13}$ the current density of the transistor Q13.

The current through the element 22 having resistance R22 is $$I_{22}=\frac{V_{22}}{R_{22}}=\frac{1}{R_{22}}V_T ln\frac{J_{15}}{J_{13}}$$

In one embodiment of this circuit the current density ratio of 16 is used by making the base-emitter junction area of the transistor Q13 4 times as large as that of the transistor Q15 and the current through the transistor Q15 4 times the current through the transistor Q13. The current across the resistance 22 becomes $$I_{22}=\frac{1}{R_{22}}V_T ln16$$

$I_{REF}$ is the current through the collector of the transistor Q13 and is equal to $I_{22}$, the emitter current of the transistor Q13, times $\alpha$.

$$I_{REF}=\alpha\frac{1}{R_{22}}V_T ln16$$

If this expression for $I_{REF}$ is substituted for expression derived for the ECL output voltage swing, equation (3), the output voltage becomes $$\frac{\alpha V_T ln16}{\alpha^{\frac{mR_{21}}{R}}}\frac{R_{21}}{R_{22}}\alpha^2\frac{R_{34}}{R_{33}}=\frac{V_T ln16}{\alpha^{\frac{mR_{21}}{R}-1}}\alpha^2\frac{R_{21}R_{34}}{R_{22}R_{33}}$$

Thus, for an ECL circuit as shown in FIG. 5, $$m\frac{R_{21}}{R} - 1$$

should equal to 2 to eliminate $\alpha$ dependence. Similarly $$m\frac{R_{21}}{R} - 1 = 3$$

eliminates $\alpha$ dependence of ECL circuits having two-tiered switching transistors.

It should be noted that while the present invention has been discussed in terms of NPN transistor, it can also be implemented with PNP transistors with appropriate changes in operating voltages and the like by one skilled in the art.

Accordingly, while the invention has been particularly shown and described with reference to the preferred embodiments, it would be understood by those skilled in the art that changes in form and details may be made therein without departing from the spirit of the invention. There is therefore intended that an exclusive right be granted to the invention as limited only by the metes and bounds of the appended claims.

What is claimed is:

1. A current source circuit comprising a first resistance element coupled between a first voltage supply source terminal and an output node, a first transistor forming a collector-emitter current path between said output node and a second voltage supply source terminal, a first current path having a second resistance element coupled to said first voltage supply source terminal, a third resistance element coupled to said second voltage supply source terminal, and a second transistor forming a collector-emitter current path between said first and second resistance elements, and having a base electrode coupled to said output node, a second current path having a fourth resistance element, a third transistor forming a collector-emitter current path between said first voltage supply source and said fourth resistance element, and having a base electrode coupled to a collector electrode of said second transistor, and a fourth transistor in a diode-connected mode forming a collector-emitter current path between said fourth resistance element and said second voltage supply source terminal, and having a base terminal coupled to a base electrode of said first transistor.

2. A circuit as in claim 1 wherein all of said transistors are of NPN polarity type.

3. A circuit as in claim 2 further comprising a forward-biased diode voltage displacement means coupled in series with said third resistance element between said second transistor and said second voltage supply source terminal.

4. A current source circuit comprising:

a first resistance element coupled between a first voltage supply terminal and an output node;

means for generating a first current proportional to the voltage at said output node;

a second resistance element connected between said first current generating means and said first voltage supply terminal, said first current through said second resistance element defining a voltage thereacross;

means responsive to said voltage for generating a second current proportional thereto;

means connected between said output node and a second voltage supply terminal for generating a third current equal to said second current;

whereby said third current provides for a feedback control of an output current from said output node;

said second current generating means further comprises:

a third resistance element, a first transistor forming an emitter-collector current path between said first voltage supply terminal and said third resistance element, a base electrode of said first transistor connected to a node between said second resistance element and said first current generating means, and a first forward-biased diode voltage displacement means connected between said third resistance element and said second voltage supply terminal;

said third current generating means further comprises a second transistor forming an emitter-collector current path between said output node and said second voltage supply terminal, a base terminal of said second transistor connected between said third resistance element and said diode voltage displacement means; and said first current generating means further comprises:

a fourth resistance element connected to said second voltage supply terminal, and a third transistor forming an emitter-collector current path between said second and fourth resistance elements, a base terminal of said third transistor being connected to said output node.

5. A current source circuit as in claim 4 wherein all of the transistors of said circuit are of one polarity type.

6. A circuit as in claim 5 further characterized by the resistance values of said first and third resistance elements, and said second and fourth resistance elements being equal, whereby said output current is independent of the voltage at said output voltage and said supply voltages.

7. A current source circuit as in claim 5 further characterized by a second forward-biased diode displacement means connected between said third transistor and said second voltage supply terminal in series with said fourth resistance element, and the resistance values of said first and third resistance elements are equal whereby said output current is proportional to the voltage at said output node minus two forward-biased diode voltage displacements.

8. A current source circuit comprising a first resistance element connected between a first supply voltage terminal and an output node, a first NPN transistor having a collector electrode connected to said output node and an emitter electrode connected to a second supply voltage terminal, a second NPN transistor having a collector electrode connected to said first supply voltage terminal through a second resistance element, an emitter electrode connected to said second voltage supply terminal through a third resistance element, and a base electrode connected to said output node, a third NPN transistor having a collector electrode connected to said first supply voltage terminal and a base electrode connected to said second transistor collector electrode, a fourth NPN transistor having a collector electrode connected to an emitter electrode of said third transistor through a fourth resistance element, an emitter electrode connected to said second voltage supply terminal, and a base electrode connected to said collector electrode and further connected to a base electrode of said first transistor.

9. A current source circuit as in claim 8 further comprising a forward-biased diode means connected between said second transistor emitter electrode and said third resistance element.

* * * * *